United States Patent [19]

Fritsch

[11] Patent Number: 4,749,342

[45] Date of Patent: Jun. 7, 1988

[54] DIAPHRAGM PUMP WITH HYDRAULICALLY DRIVEN ROLLING DIAPHRAGM

[75] Inventor: Horst Fritsch, Leonberg, Fed. Rep. of Germany

[73] Assignee: LEWA Herbert Ott GmbH & Co., Fed. Rep. of Germany

[21] Appl. No.: 812,347

[22] Filed: Dec. 23, 1985

[30] Foreign Application Priority Data

Dec. 21, 1984 [DE] Fed. Rep. of Germany ..... 3446914

[51] Int. Cl.[4] ..... F04B 9/08; F04B 35/02

[52] U.S. Cl. ..... 417/388; 92/98 D

[58] Field of Search ..... 417/383-388; 92/98 D

[56] References Cited

U.S. PATENT DOCUMENTS

| | | | |
|---|---|---|---|
| 2,820,434 | 1/1958 | Otto | 92/98 D |
| 3,203,186 | 8/1965 | Sheppard | 92/98 D |
| 3,769,879 | 11/1973 | Lofquist | 417/386 |
| 4,292,887 | 10/1981 | Ohta | 92/98 D |
| 4,338,854 | 7/1982 | Margetts | 92/98 D |

FOREIGN PATENT DOCUMENTS

| | | | |
|---|---|---|---|
| 1005555 | 9/1965 | United Kingdom | 92/98 D |

*Primary Examiner*—Carlton R. Croyle

*Assistant Examiner*—Jane E. Obee

*Attorney, Agent, or Firm*—Bierman and Muserlian

[57] ABSTRACT

In a diaphragm pump with a diaphragm in the form of a rolling diaphragm that separates a delivery chamber from a fluid-filled pressure chamber and that with its peripheral edge is firmly clamped between a casing body and pump cover, and with an oscillating hydraulic piston which is displaceable in a bore of the casing body between the pressure chamber and a hydraulic reservoir, so as to actuate the diaphragm, the rolling diaphragm rolls alternatingly up an outer roll-off cylinder formed by the wall of the pressure chamber and off an inner roll-off cylinder formed by the peripheral surface of a support piston for the rolling diaphragm that is axially displaceable in the pressure chamber, the front surface of which support piston is connected with the corresponding surface section of the rolling diaphragm. The inner roll-off cylinder of the support piston shaped as a support plate gradually changes, in the rear limit position of the rolling diaphragm, into the outer roll-off cylinder by way of a support shoulder, which, for the completely mechanical support of the rolling diaphragm, together with the two roll-off surfaces forms a completely gap-free support surface adapted to the natural form and roll-off geometry of the rolling diaphragm.

6 Claims, 3 Drawing Sheets

DIAPHRAGM PUMP WITH HYDRAULICALLY DRIVEN ROLLING DIAPHRAGM

The invention is concerned with a diaphragm pump with a diaphragm in the form of a rolling diaphragm that separates a delivery chamber from a fluid-filled pressure chamber and that with its peripheral edge is firmly clamped between a casing body and a pump cover, and with an oscillating hydraulic piston which is displaceable in a bore of the casing body between the pressure chamber and a hydraulic reservoir, so as to actuate the diaphragm, with the rolling diaphragm alternatingly rolling off and up an external roll-off cylinder which is formed by the peripheral surface of a support piston for the rolling diaphragm that is axially displaceable in the pressure chamber, the front surface of which support piston is connected with the corresponding surface section of the rolling diagram.

In the known diaphragm pumps, differently shaped and supported diaphragm are used, and for which a maximum allowable delivery pressure can be set depending on the form of the diaphragm and on the type of support.

For high pressure diaphragm pumps, the diaphragms of which are actuated hydraulically exclusively, level or preformed plate-shaped flat diaphragms are employed. They can be composed either of a plastic material with a use limit of up to approx. 350 bar delivery pressure, or of metal with a use limit of over 3000 bar delivery pressure.

With the flat diaphragms of plastic material there obtains—in contrast to the metal diaphragm—the advantage of high elasticity and with it great deflection, so that such plastic flat diagrams have relatively small diameters. But they still yield substantially larger pump head diameters than a piston pump with similar performance. The price difference between piston pump and diaphragm pump is correspondingly wide.

It is therefore desirable to use in diaphragm pumps, especially in those for high delivery pressures, such diaphragm forms that permit greater deflections and thus smaller diameters than flat diaphragms.

A diaphragm pump of the aforementioned type with a diaphragm in the shape of a rolling diaphragm is already known, in which the rolling diaphragm alternately rolls off or up an outer roll-off cylinder and an inner roll-off cylinder formed by the wall of the pressure chamber, which [cylinder] is formed by the peripheral surface of a support piston for the rolling diaphragm that is axially displaceable in the pressure chamber, the front surface of which support piston is connected with the corresponding surface section of the rolling diaphragm.

In such a known diaphragm membrane, a so-called fluid support for the rolling diaphragm is provided at the transition point between the outer and the inner roll-off cylinders. In a disadvantageous manner, such a liquid support disregards that a rolling diaphragm is relatively sensitive to pressure differences that arise and therefore always requires a sufficient support. This applies particularly to the rear limit position of the rolling diaphragm at the end of the piston intake stroke, since in this rear limit position the leak addition effected by way of the relief valve of the pump and, appropriately, also ventilation and/or degassing takes place. In this state of the pump's re-blowing, the rolling membrane must be perfectly supported or be able to align itself at a suitable place, since the relief [blow] valve acts only when there is a sufficient pressure difference between the hydraulic pressure chamber and the delivery chamber. This means, however, that at this moment the rolling diaphragm is under relatively high pressure, unless it is efficiently supported. In an extreme case, the diaphragm may be subjected in its rear limit position to a pressure difference that corresponds to the full delivery pressure of the pump, for example, 350 bar. This case can occur when, e.g., with the pump standing still, due to minor leak of the pressure valve, the system pressure in the pump work-chamber will be equal to the delivery pressure. For safety reasons, the rolling diaphragm must be able to withstand this load.

However, practice has shown that the known fluid support is not able to meet the aforesaid requirements in a sufficient manner. The result was that thus far a rolling diaphragm could not be successfully used in such diaphragm pumps with which especially higher delivery pressures must be handled and in which a hydraulic diaphragm drive is advantageous, in order to ensure that an even pressure obtain on both sides of the diaphragm.

The invention therefore has the object of designing the diaphragm pump of the generic type in such a way, to ensure removal of the disadvantages described, that the rolling diaphragm will withstand in its rear limit position the high pressures possibly acting there, caused especially by great pressure differences.

This problem is solved by the characteristics of claim 1. Advantageous embodiments thereof are described in the additional claims.

The diaphragm pump with hydraulically driven rolling diaphragm created by the invention is advantageously suitable also for high delivery pressures, with an efficient support of the rolling diaphragm provided in the rear limit position; in this manner, it is certainly prevented that the rolling diaphragm could be damaged during an increase of the pressure on the delivery side.

On the basis of the completely mechanical support of the rolling diaphragm in its rear limit position provided by the invention, it is possible to restore by the usual blow valve the minor leakages occurring in the pressure chamber, without the risk that the rolling diaphragm would be damaged in this position due to the then obtaining pressure difference.

Thus, a completely slitless contact surface is provided for the rolling diaphragm, which, when the rolling diaphragm is in its rear limit position, is formed by the corresponding surfaces of the pressure chamber and of the support plate. Such a surface naturally has no borings. This is particularly important, in order to prevent a contact of the rolling diaphragm with such borings when a pressure difference the pump.

The invention has also made possible that substantially smaller diaphragm diameters can now be used. This has the advantage of an exceptionally low-priced design, since it requires considerably less space. This is not least due to that based on the substantially greater deflection of a rolling diaphragm as compared to a flat diaphragm, the hydraulic cylinder serving to drive the diaphragm can also have a substantially smaller diameter, so that thereby the pressure impacted area becomes smaller. In addition, the propeller thrusts required for the pump are decisively reduced. This also contributes much to reducing the cost of a diaphragm pump with rolling diaphragm.

As is known, a rollng diaphragm basically is constituted of a hose-shaped rubber diaphragm that has an extremely long service life, since it can be rolled up and off with great frequency, without rupturing. Accordingly, the rolling diaphragm made of a rubber-like material rolls alternatingly up on the outside roll-off cylinder formed by the wall of the pressure chamber, and rolls off the inner roll-off cylinder which is formed by the outside peripheral surface of the axially displaceable support plate. This rolling up and off of the rolling membrane is accomplished approximately like the movement of a hose or a sock during dressing and undressing.

The invention has made it possible for the first time that rolling diaphragms can be used in such diaphragm pumps, with which particularly high delivery pressures must be handled, and where thus a hydraulic drive of the diaphragm is an advantage, in order to ensure that balanced pressure obtains on both sides of the diaphragm.

In the diaphragm pump according to the invention, the embodiment is in such a form that the front surfaces of the support plate are firmly connected with the respective surface section of the rolling diaphragm. The inner roll-off cylinder is shaped so that in the rear limit position of the rolling diaphram it forms together with the outer roll-off cylinder a completely slitless support surface which is adapted to the natural forming and roll-off geometry of the rolling diaphragm. In this manner, a clear position limit and/or support is created in the rear dead center position of the rolling diaphragm, so that in this rear limit position of the rolling diaphgram it is possible to restore by the usual relief [blow] valve the minor leaks occurring in the pressure chamber, without running the risk that the rolling diaphragm would be damaged in this position by virtue of the then obtaining pressure difference.

It is furthermore provided by the invention that the support plate will in the rear limit position be at least partially immersed in a pressure chamber section of a smaller diameter which adjoins the larger diameter pressure chamber section constituting the outer roll-off cylinder, thus forming a support shoulder for the rolling diaphragm.

It is thereby made possible in a further development of the invention to arrange radial flow passages provided in the peripheral wall of the support plate and serving to provide the connection between the pressure chamber and the relief [blow] valve, in such a manner that in the rear limit position they are completely immersed in the pressure chamber section with smaller diameter.

The stop limiting the rear position of the support plate is appropriately formed by an annular shoulder in the casing body, provided at the end of the pressure chamber section with smaller diameter.

In a practical embodiment of the invention, the support plate exhibits a guide rod which ensures an exactly centric axial movement of the support plate.

Based on the provided hydraulic actuation of the rolling diaphragm, the support plate and its guide rod have no mechanical connection with the hydraulic piston. This means that the support plate is moved reciprocatingly only by the rolling diaphragm. The support plate, accordingly independent of the kinematics of the hydraulic piston, performs two functions. First, it permits the off-rolling of the rolling diaphragm, which for off-rolling requires an outer roll-off cylinder, formed by the wall of the pressure chamber, as well as an inner roll-off cylinder which is formed by the external peripheral surface of the support plate. Secondly, the support plate performs the function of providing support to the rolling diaphragm.

Altogether, the design according to the invention is such that in the rear limit position of the rolling diaphragm such an overall contour is formed by the support plate including the pressure chamber that a slitless surface is created and that as a result thereof, when a pressure difference occurs, the rolling diaphragm is pressed only against smooth surfaces and is accordingly not exposed to the risk of being damaged.

The invention has in this manner made possible that for diaphragm pumps intended particularly for high delivery pressures, hydraulically driven rolling diaphragms can be used, which permits a considerable reduction of the diameter of the diaphragm pump. The diameter of the rolling diaphragm can hereby be in a size on the order of the diameter of the hydraulic piston, so that also the propeller thrusts required for the diaphragm pump become very much smaller. For example, the reduction of the diaphragm diameter to half the previous diameter has resulted in a reduction of the thrust to one quarter the previously required expenditure of force.

In the following, the invention is explained in detail, with the aid of the drawings. Thus, FIG. 1 shows a diaphragm pump designed according to the invention, in section, with the rolling diaphragm in the front limit position;

Figure 1:
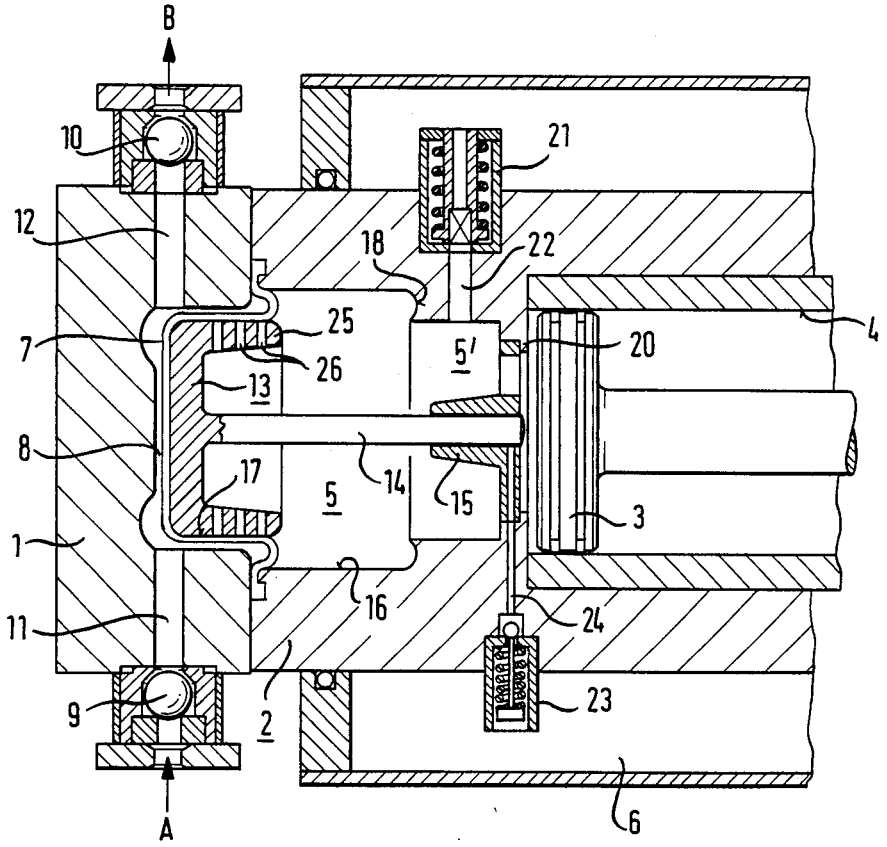
Figure 2:
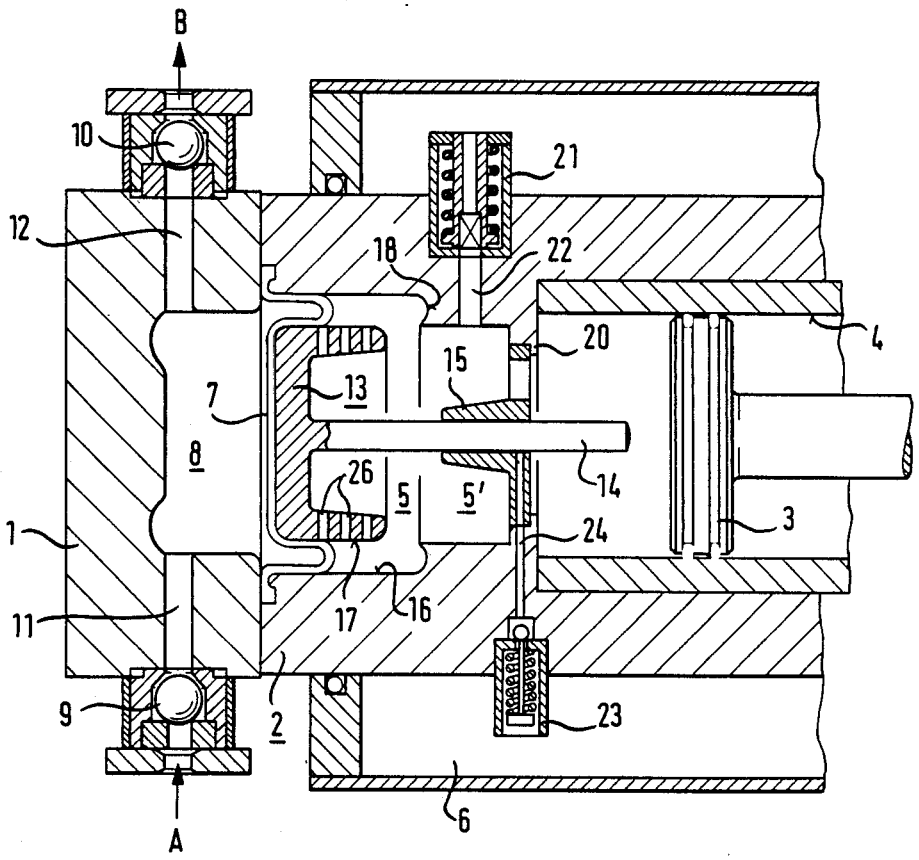
FIG. 2 shows the above with the rolling diaphragm in a central position.

As can be seen from the drawing, the diaphragm pump illustrated has a pump casing in the form of a casing body 2 closed on the front side by a pump cover 1, in which casing the oscillating hydraulic piston 3 acts as the hydraulic diaphragm drive. It moves reciprocatingly in a bore 4 of the casing body and separates a pressure chamber 5 from a hydraulic reservoir 6.

A rolling membrane 7 is firmly clamped with its peripheral edge between the casing body 2 and the pump cover 1, separating the pressure chamber 5 from a delivery chamber 8 in the manner shown in the drawing. The pressure chamber 5 is filled completely with hydraulic fluid, so that when the hydraulic piston 3 is in reciprocating motion, the rolling diaphragm is actuated in the appropriate manner and acts on the delivery chamber 8 in the sense of an intake stroke and/or discharge stroke.

The pump cover 1 has a spring-loaded intake valve 9 as well as a spring-loaded pressure valve 10. These valves 9, 10 are connected with the delivery chamber 8 by way of an inlet passage 11 and an outlet passage 12, respectively, in such a manner that the delivery medium is sucked during the intake stroke of rolling diaphragm 7 in the direction of arrow A into the delivery chamber 8 by way of intake valve 9 and inlet passage 11, said intake stroke being towards the right on the drawing. On the other hand, during the discharge stroke of the rolling diaphragm 7 then taking place towards the left according to the drawing, the delivery medium is discharged in metered form from the delivery chamber 8 by way of outlet passage 12 and pressure valve 10 in the direction of arrow B.

Inside the pressure chamber 5, a support plate 13 is arranged axially displaceably, which has a guide rod 14 jutting out axially rearward in the direction of hydraulic piston 3. This guide rod is guided through an eye 15 arranged centrally in the pressure chamber 4, in such a manner that an exactly centric axial movement of the support plate 13 is ensured.

At its front surface, the support plate 13 is connected to the associated surface section of rolling diaphragm 7, so that thereby the support plate 13 following the axial movement of rolling diaphragm 7.

The roll-off surface required for the rolling diaphragm 7 is formed by an outer roll-off cylinder as well as by an inner roll-off cylinder. In this regard, the peripheral wall 16 of pressure chamber 5 constituted the outer roll-off cylinder, while the inner roll-off cylinder is formed by the outside peripheral surface 17 of support plate 13.

As can be seen, a pressure chamber section 5' of smaller diameter adjoins the actual pressure chamber 5 axially rearwards in the direction of hydraulic piston 3, with a support shoulder 18 for rolling diaphragm 7 being formed between the two pressure chamber sections 5, 5'. This support shoulder 18 is in concave shape in the exemplified embodiment illustrated and has a radius which corresponds to the bend radius of rolling diaphragm 7 in the latter's roll-off zone.

Figure 3:
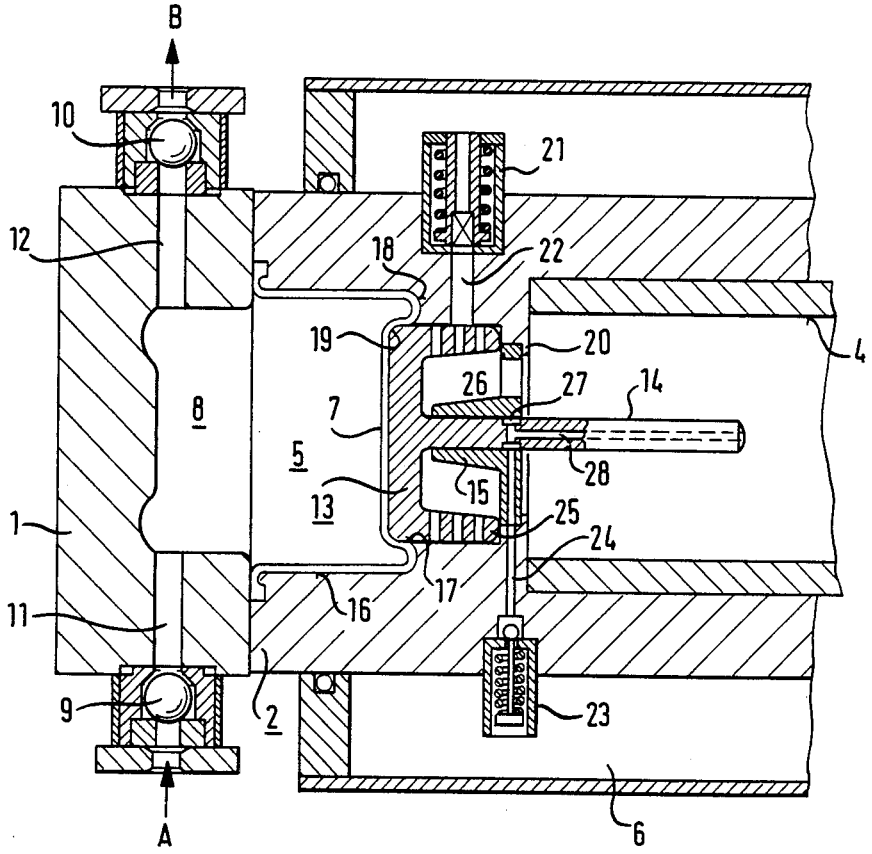
FIG. 3 shows the above with the rolling diaphragm in the rear limit position.

The diameter and the depth of the smaller pressure chamber section 5' are such that the support plate 13, in the rear limit position according to FIG. 3, is immersed to a predominant part in this smaller pressure chamber section 5'. The front part of support plate juts out from the pressure chamber section 5' only so far that only the round-shaped surface section 19 of the support plate 13, which forms the transition between the front surface and the outside peripheral surface 17 of support plate 13, will be situated in the larger pressure chamber section 5.

As can be seen in FIG. 3, a completely slitless support surface 16, 18, 19 (and 17, if appropriate) is formed in the rear limit position of rolling diaphragm 7, which is adapted to the natural form-geometry and to the roll-off characteristic of rolling diaphragm 7, respectively. In the exemplified embodiment shown, this slitless support surface is composed of the outer roll-off cylinder, formed by the peripheral wall 16 of pressure chamber 5, of the support shoulder 18 and of the rounded surface section 19 and/or the inner roll-off cylinder 17 of support plate 13, inclusive of the front surface of the support plate.

As stop for limiting the rear position of support plate 13, an annular shoulder 20 is provided, which is formed in the casing body 2 at the axially rear end of smaller diameter pressure chamber segment 5'.

As can be seen, the hydraulic reservoir 6 is connected to a combined gas-expelling and pressure-limiting valve 21 which in turn opens out by way of passage 22 into the smaller-diameter pressure chamber section 5'. To this end, radial flow passages 26 are provided in the peripheral wall of support plate 13. They are arranged in such a manner that in the rear limit position of rolling diaphragm 7 and/or support plate 13 according to FIG. 3, they are completely immersed in the smaller-diameter pressure chamber section 5'. This also ensures that a completely slitless support surface is formed in the rear limit position of rolling diaphragm 7.

In addition, a relief [blow] valve 23 is provided to connect the hydraulic reservoir 6 with the smaller-diameter pressure chamber section 5' by way of a passage 24. In this manner, the necessary leak restoration can be effected from the hydraulic reservoir by way of relief valve 23 and passage 24, in the rear limit position of rolling diaphragm 7, i.e., at the end of the intake stroke of hydraulic piston 3. This passage 24 is arranged in such a manner that the connection to the hydraulic reservoir 6, by way of an annular slot 27 and a bore 28 in the guide rod 14 of the support plate, is effected only when the support plate 13 has reached the rear limit position, as shown in FIG. 3. A leak-restoration of pressure chamber 3 in the desired manner is thereby possible only in this position of support plate 13, which means in other words that a premature leak restoration cannot take place.

I claim:

1. In a diaphragm pump having a roll-type diaphragm adapted to separate a delivery chamber from a liquid-filled first pressure chamber wherein a peripheral edge of said diaphragm is adapted to be firmly clamped between a housing body and a pump cover, an oscilating hydraulic piston adapted to slide in a bore of the housing body between said first pressure chamber and a hydraulic storage chamber for actuation of the diaphragm, the diaphragm being adapted to alternately roll and unroll on an outer roll-off surface comprising a wall of the pressure chamber and an inner roll-off surface comprising a peripheral face of a support piston adapted for axial movement in the first pressure chamber, said support piston having a supporting plate attached to an associated surface section of the diaphragm, the improvement comprising a supporting shoulder (18) connected between said outer roll-off and inner roll-off surfaces, the peripheral face (17) of said inner roll-off surface adapted when said support piston (13) is in its rear-most position of axial movement to form a continuous and gap-free support surface with said outer roll-off surface, said supporting shoulder (18) and said supporting plate, and wherein the entire support surface (16,18,17,19) is gap-free and arranged to naturally unroll and be completely supported by said support surface.

2. The diaphragm pump of claim 1 wherein the supporting plate is adapted to be at least partially immersed into a second pressure chamber at said rear-most position, said second pressure chamber being of smaller diameter than said first pressure chamber and contiguous thereto.

3. The diaphragm pump of claim 1 wherein the supporting shoulder is concave and has a radius of curvature which corresponds to a radius of curvature of the diaphragm when said diaphragm is supported thereon.

4. The diaphragm pump of claim 1 wherein radially extending flow channels are arranged in the peripheral face of the support piston and adapted to be completely immersed in the second pressure chamber when said piston is in said rear-most position.

5. The diaphragm pump of claim 1 comprising an annular shoulder in the housing body adapted to form a stop for limitation of the rear-most position of the support piston.

6. The diaphragm pump of claim 1 wherein the supporting plate has a guide rod for exactly centered axial movement of the supporting plate.

* * * * *